United States Patent [19]

Rabino

[11] 4,370,822

[45] Feb. 1, 1983

[54] CONVERTIBLE FIREARM-AIRGUN

[76] Inventor: Villarosal A. Rabino, 28 Frankfort St., Daly City, Calif. 94104

[21] Appl. No.: 158,968

[22] Filed: Jun. 12, 1980

[51] Int. Cl.[3] ..... F41C 27/00

[52] U.S. Cl. ..... 42/1 R; 42/16; 124/58

[58] Field of Search ..... 42/1 R, 16, 69 A, 69 R; 124/58

[56] References Cited

U.S. PATENT DOCUMENTS

| | | | |
|---|---|---|---|
| 127,873 | 6/1872 | Hannah | 42/1 R |
| 2,110,509 | 3/1938 | Von Latscher-Latka et al. | 124/58 |
| 2,605,756 | 8/1952 | Bertschinger | 124/58 |

*Primary Examiner*—Charles T. Jordan

*Attorney, Agent, or Firm*—Townsend and Townsend

[57] ABSTRACT

A weapon which can be simply and quickly converted for use as either a firearm or as an airgun is disclosed. Removable chamber devices and bolt faces are adapted for different types of projectiles, such as pellets or cartridges. A number of bolt faces and chamber devices are provided for each type of projectile used. A conventional pressurized gas assembly provides the pressurized gas needed to propel the pellet. A hammer and trigger assembly mounted below the bolt housing releases a hammer to fire the weapon. When in the firearm mode, the hammer strikes a firing pin extending from the cartridge bolt face. When used in the airgun mode, the hammer strikes a gas pin which allows pressurized gas to enter into the pellet chamber device forcing the pellet out of the barrel. After each shot, the bolt assembly is drawn rearward to recock the weapon by either a firing pin in the firearm mode or by a hammer puller in the airgun mode, each extending into the path of the hammer from the corresponding bolt face.

23 Claims, 9 Drawing Figures

CONVERTIBLE FIREARM-AIRGUN

This invention is related to convertible weapons, particularly one which can be used both as an airgun and as a firearm.

BACKGROUND OF THE INVENTION

People often desire that a single article be capable of use in different modes. For example, a weapon capable of firing a relatively high powered round may be modified or adapted to accept a round of the same caliber but having a smaller shell casing. These smaller rounds cost less so that practice firings on rifle ranges become much more economical. A number of U.S. Pat. Nos., such as 4,169,329; 4,058,922; 3,776,095, are directed to such conversions.

A different type of weapon conversion involves a weapon that is specifically designed to be used either as an airgun or as a firearm. This type of convertible weapon allows the user the choice of firing either inexpensive pellets or darts as well as more expensive, but more powerful, cartridges. U.S. Pat. No. 127,873 discloses a weapon which can be used as either a firearm or an airgun. U.S. Pat. No. 2,605,756 discloses a device mounted within the breech of a firearm to allow the weapon to be used as an airgun. However, neither of these patents disclose a weapon which can be easily modified to tailor the chamber and bolt face for the particular firing mode to be used, as well as to the particular cartridge or gas powered projectile used. It is obvious that a chamber which is designed for housing a cartridge will probably not be the optimal configuration for use with a pellet or dart. Further, chamber configurations for pellets may be different for optimal functioning compared to that for a dart. Similarly, cartridge casings for different types of rounds of ammunition often call for a different chamber size even though the bullet is the same diameter.

SUMMARY OF THE INVENTION

A weapon which can be simply and quickly converted for use as either a firearm or as an airgun is disclosed. The invention insures optimal performance of the weapon when used either as an airgun or as a firearm through the use of removable chamber devices and bolt faces configured for the particular projectile used.

In the preferred embodiment, the weapon can be used to fire .22 caliber cartridges or .22 caliber pellets. This conversion is possible through the use of removable chamber devices and corresponding removable bolt faces adapted for the different firing mode and particular projectile used. The chamber end of a barrel is attached to a bolt housing, such as by threads on the barrel and the bolt housing. The bolt housing has a longitudinal cavity aligned with and generally parallel to the bore of the barrel. The chamber devices are locked into a portion of this cavity adjacent the bore of the barrel through the use of a thumb screw passing through bolt housing and into a detent in the chamber device. Within the bolt housing cavity a bolt assembly is located. The bolt assembly consists of a forward facing (toward the muzzle of the barrel) removable bolt face and a bolt. A number of bolt faces are provided, each adapted to the type of projectile and thus the type of chamber device being used.

The disclosed embodiment illustrates the invention adapted for use with a weapon fired from the shoulder.

A conventional pressurized gas assembly, which typically uses $CO_2$ cartridges, is used to provide the pressurized gas needed to propel the pellet. A hammer and trigger assembly mounted below the bolt housing release a hammer when a trigger is pulled.

When used in the cartridge firing or firearm mode, the hammer strikes a portion of a firing pin extending into the path of the forward moving hammer. The firing pin is a part of the particular bolt face designed for use with the particular cartridge being fired. The struck firing pin strikes the head or rim of the cartridge to cause the round to fire.

When pellets are used, the pellet bolt face contains no firing pin. Therefore, the hammer continues along its forward moving path and strikes a gas pin which allows pressurized gas to enter into the pellet chamber of the pellet chamber device behind the pellet. This pressurized gas thus forces the pellet through the bore and out of the muzzle of the barrel. The gas pin is spring biased to reseal the exit port after an appropriate amount of pressurized gas has been used to propel the pellet.

After each shot, the bolt assembly is drawn rearward to recock the weapon, i.e., to force the hammer rearward against the force of the firing spring where it is held in place by the trigger assembly. The hammer is forced back by either the struck portion of the firing pin when in the firearm mode or by a hammer puller extending into the path of the hammer from the pellet bolt face when in the airgun mode.

When the weapon is being used to fire cartridges, the expended shell is extracted from the cartridge chamber device by an extractor on the cartridge bolt face and ejected by the forward force of the firing pin on the cartridge rim. The invention also discloses a simplified means for locking the bolt assembly in its forwardmost position during firing, a two-position safety, a captured firing pin, a twin pivot trigger assembly for greater trigger control, and a dual-power hammer for use in the airgun mode.

A primary advantage of the present invention is that it is particularly adapted for use with commercially available .22 caliber pellets as well as .22 caliber cartridges be they either short, long, long rifle, or magnums. This advantage accrues through the use of easily replaceable and simply installed chamber devices and bolt faces, each adapted for optimum performance with its respective projectile. Thus, for example, the pellet bolt face includes packing for contact with the rear face of the pellet chamber device to ensure that compressed gas does not leak past the interface of the bolt face and chamber device. Likewise, when cartridges are being used, a chamber device and a bolt face specifically designed for use with the particular cartridge chosen. Although it is possible to use the same chamber device for .22 caliber shorts, longs, and long rifles, a separate cartridge device is needed using the magnum because the casing is a different size. Also, if desired a chamber device could be designed to be specifically adapted for use with an air dart. Therefore, optimal operation for the particular projectile chosen is ensured.

With the present invention an entire bolt assembly need not be provided for each firing configuration. The provision of replaceable bolt faces, as compared to replacing the entire bolt for each type of projectile, keeps the total size smaller, the weight less, and the cost lower.

Converting the weapon of the present invention from one firing mode to another is very simple and easily done without the need for tools of any kind. The bolt assembly is drawn back to expose the outer knurled end of the bolt face mounting screw whereupon the bolt face can be removed from the bolt. A thumbscrew securing the chamber device in the chamber cavity of the bolt housing is loosened to allow a user to remove the chamber device. For ease of removal, the chamber device has a thumbnail groove near its rear face. A new chamber device and bolt face can then be mounted at their respective positions. No other adjustments need be made even when converting between the airgun and the firearm modes.

Provision is made in the butt of the rifle for storage of the various chamber devices and bolt faces. A number of these items can be so stored because of the small size of these respective parts. Thus flexibility and portability is enhanced.

Also provided is a dual pivot trigger assembly for added control. Since the same, unmodified hammer and trigger assembly is used regardless of the mode in which the weapon is used, the design is simplified and the cost to the user is lowered.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
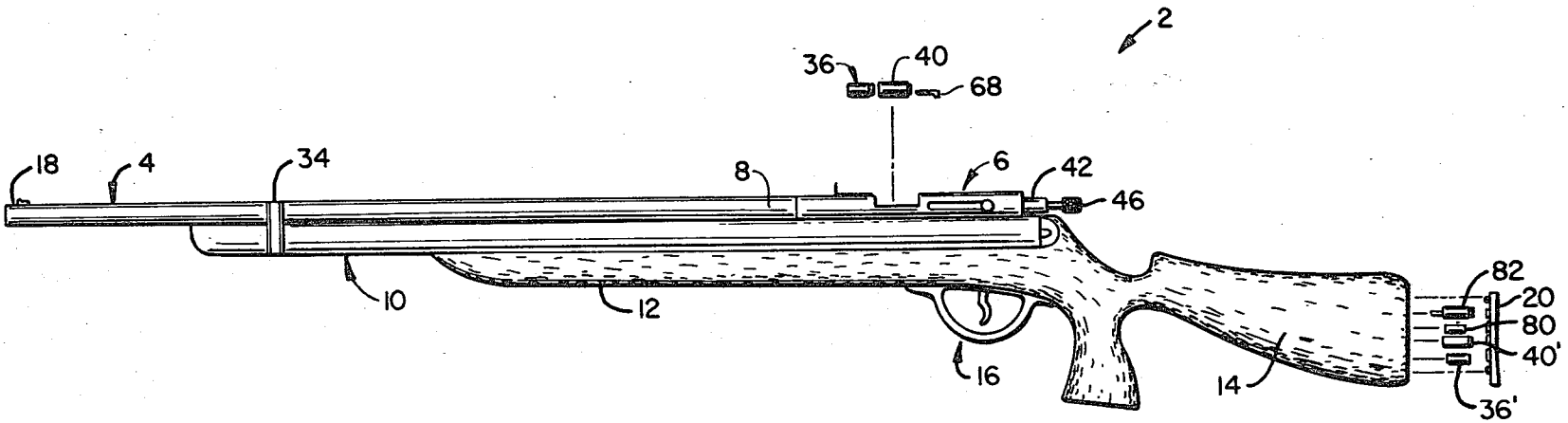
FIG. 1 is an overall view of an embodiment of the weapon according to the present invention.

Turning now to FIG. 1, the firearm-airgun (or weapon) 2 of the present invention comprises generally a barrel 4, a bolt housing 6 mounted to the chamber end 8 of the barrel, a gas chamber/hammer assembly enclosure 10 mounted to the barrel and bolt housing, a fore stock 12, a shoulder stock 14, and a trigger assembly 16 mounted to enclosure 10 in the area below the bolt housing. The terms forward and rear, as used herein, shall mean in the direction toward the muzzle 18 of the barrel and toward the butt plate 20 of the shoulder stock, respectively. The disclosed embodiment will be described in the following sequence: firearm mode, airgun mode, hammer and trigger assemblies, other features, operation in the two modes, and finally alternative embodiments.

FIREARM MODE

Figure 2:
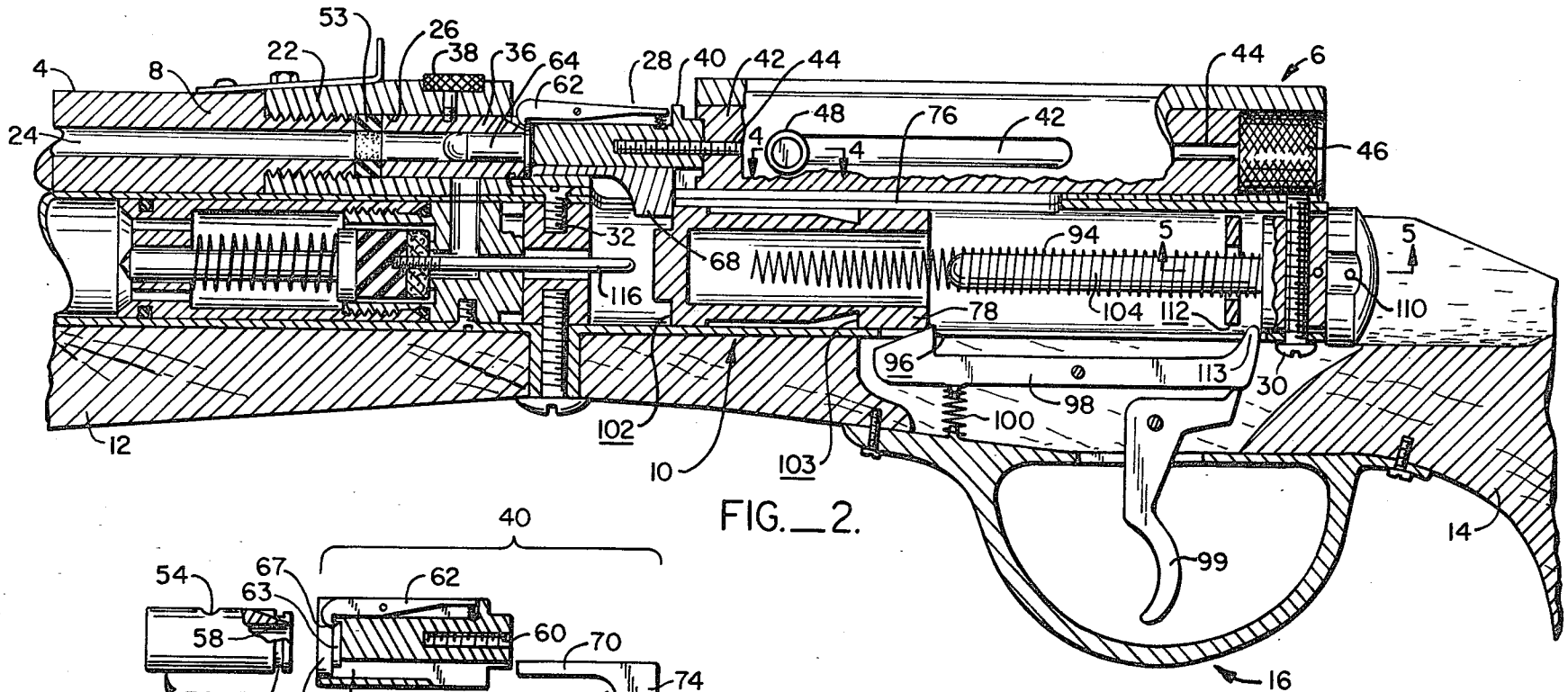
FIG. 2 is a partial side cross-sectional view shown in its firearm mode.

Turning to FIG. 2, the main operating features of the weapon of the present invention in the firearm mode are shown. The chamber end of the barrel is threadably mounted to the forward end 22 of the bolt housing. The barrel has a bore 24 extending entirely along the barrel between chamber end 8 and muzzle 18. The bore is typically provided with rifling in the usual manner. The bolt housing is a generally tubular structure having relatively thick walls defining a chamber cavity 26 adjacent the chamber end of the barrel. Immediately to the rear of the chamber cavity, the bolt housing has a projectile port 28 formed through the side of bolt housing 6 providing access to cavity 26.

Enclosure 10 is a substantially tubular member and is mounted to the bolt housing by screws 30 and 32. Enclosure 10 is mounted at its forward end to the barrel by a band 34 shown in FIGS. 1 and 3.

A cartridge chamber device 36 is shown in FIG. 2 mounted within chamber cavity 26 and secured by a thumbscrew 38. A bolt assembly is housed within bolt housing 6 and comprises a cartridge bolt face 40, a bolt 42, and a bolt face mounting screw 44. Mounting screw 44 passes axially through a hole in bolt 42 to mount the bolt face to the bolt so that the forward end of the bolt abuts the rearward end of the bolt face. Threadable engagement of the bolt face is accomplished by turning the outer knurled end 46 of mounting screw 44.

Figure 4:
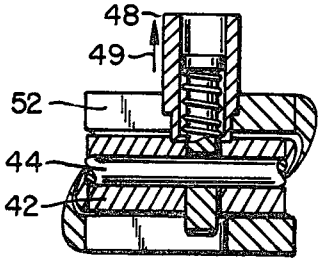
FIG. 4 is an enlarged cross-sectional view of the bolt handle taken along lines 4—4 of FIG. 2.

The bolt is moved to the rear by pulling outwardly on handle 48, shown in FIGS. 2 and 4, in the direction of arrow 49 and then pushing the bolt rearward in the direction of arrow 50. It should be noticed that the outside diameter of the outer end of handle 48 is larger than the width of slot 52. However the forward end of slot 52 has a countersunk portion sized for seating the larger, outer diameter of the handle therein. The bolt is thus locked in its forward position when the handle is so seated.

Figure 2A:
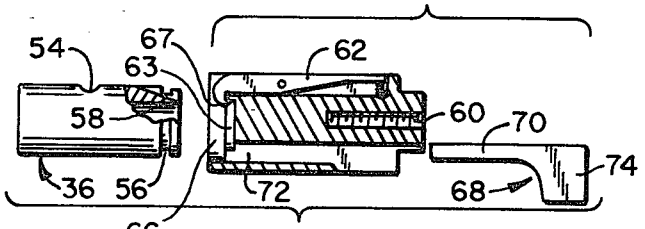
FIG. 2A is an enlarged exploded cross-sectional view of the cartridge chamber device and bolt face.

Turning now to FIG. 2A, cartridge bolt 40 and cartridge chamber device 36 will be described in detail. The cartridge chamber device is generally cylindrical having an inside cavity or chamber sized for placement of the cartridge therein. The forward end of chamber device 36, when mounted within chamber cavity 26, abuts packing 53 adjacent the rear face of the chamber end of the barrel. Device 36 has a detent 54 for engagement by thumbscrew 38. A thumbnail groove 56 is formed adjacent to the rearward end of the cartridge chamber device. This groove allows the user to easily remove the device from the chamber cavity after withdrawing the thumbscrew from the detent. Device 36 also has an inclined surface 58 which allows withdrawal and ejection of the cartridges as discussed below.

Cartridge bolt face 40 is also generally cylindrical having a threaded hole at its rearward end for engagement with mounting screw 44. A spring biased extractor 62 is pivotally mounted within a slot extending parallel to the axis of bolt face 40. The forward end of the cartridge bolt face has a pair of concentric recesses. The inner recess 63 is sized for snug placement around the rim of a cartridge 64. The outer and larger recess 66 is sized for engagement around the rearward end of the cartridge chamber device. When a cartridge is chambered and the bolt is fully forward, as in FIG. 2, the forward lip 67 of the extractor fits over the rim of the cartridge at the incline surface 58.

Cartridge bolt face 40 also includes a firing pin 68. The firing pin is an L-shaped element having one leg relatively long and slender and the other leg relatively short and thick. Slender, narrow leg 70 fits within an internal passageway 72 while thick leg 74 extends radially past the outside surface of the cartridge bolt face. When mounted to the bolt as in FIG. 2, leg 74 extends through a slender passageway 76 between the bolt housing and enclosure 10 so that a portion of thick leg 74 extends within the interior of enclosure 10. This extension allows the firing pin to be struck by a hammer 78 having a circular cross-sectional shape housed within enclosure 10 as more fully described below.

AIRGUN MODE

Figure 3:
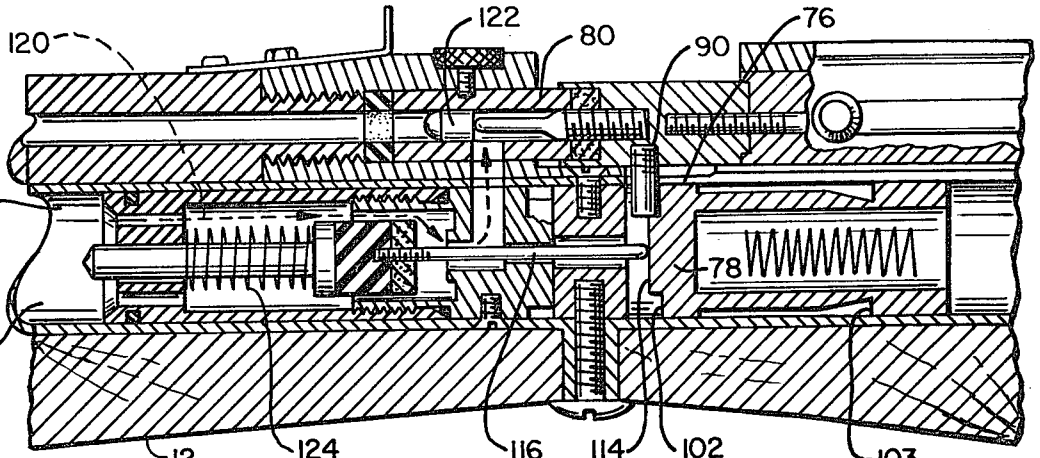
FIG. 3 is a partial side cross-sectional view detailing the operative parts of the weapon in its airgun mode.
Figure 3A:
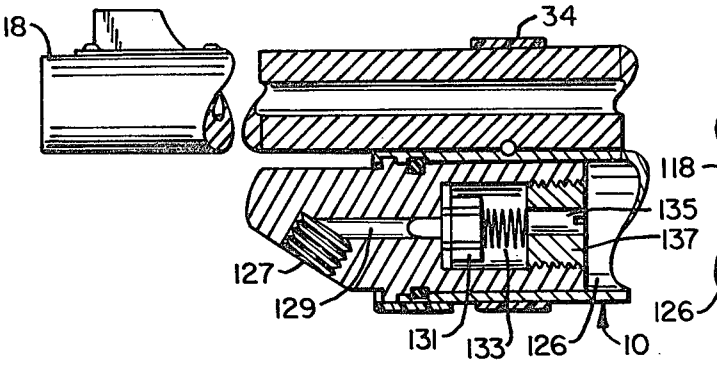
FIG. 3A is an enlarged exploded cross-sectional view of the pellet chamber device and bolt face.
Figure 3A:
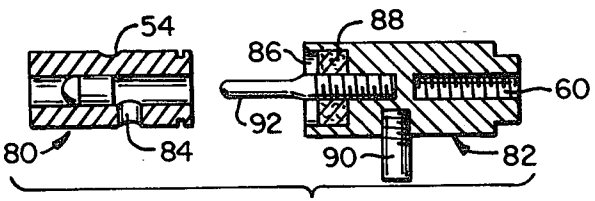

In FIGS. 3 and 3A the weapon is shown in its airgun configuration. Specifically, a pellet chamber device 80 is housed within chamber cavity 26 in lieu of the cartridge chamber device. A pellet bolt face 82 is mounted to bolt 42 in lieu of cartridge bolt face 40 in this mode. In all other respects the configuration of weapon 2 is the same. Pellet chamber device 80 is similar to cartridge chamber device 36, however device 80 lacks an inclined surface corresponding to inclined surface 58 and is provided with a gas port 84 which is formed centrally within the wall of device 80 opposite detent 54.

Pellet bolt face 82 is cylindrical having a threaded hole 60 at its rearward end as does the cartridge bolt face. The forward end of bolt face 82 has a recess 86 sized for snug placement around the rearward end of device 80. Recess 86 has packing 88, such as leather or similar packing material, placed therein so that when the bolt is seated fully forward, the rear face of the pellet chamber device forms a tight seal against packing 88 thereby preventing escape of pressurized gas past such interface.

The pellet bolt face also has a radially extending hammer puller 90, which is shown extending through passageway 76 in FIG. 3, to force the hammer 78 rearward after firing as is more fully discussed below. A loading ram 92 is mounted along the axis of pellet bolt face 82 and is sized so that a pellet placed over its end can be inserted within device 80 to a point past port 84.

HAMMER AND TRIGGER ASSEMBLIES

The hammer and trigger assemblies will now be discussed. In FIG. 2 the hammer is shown in a forward position engaging leg 74 of firing pin 68. Hammer 78 moves within the interior of the portion of enclosure 10 which underlies bolt 42. The hammer is moved rearward against a helical hammer spring 94 by moving the bolt assembly rearward. When in the firearm mode, leg 74 engages a hammer surface 102 of the hammer to force the hammer rearward while in the airgun mode puller 90 does so. When the bolt is in its rearwardmost position, a trigger surface 96 on a trigger pivot arm 98 is urged upwardly by a trigger spring 100 to engage the hammer surface 102. When in the airgun mode, the user may desire to draw the hammer (via the bolt assembly) only partially to the rear to allow trigger surface 96 to engage intermediate hammer surface 103. This allows, as more fully described below, the weapon to be fired in a full powered mode or a reduced powered mode by engagement of hammer surface 102 or 103, respectively.

Figure 5:
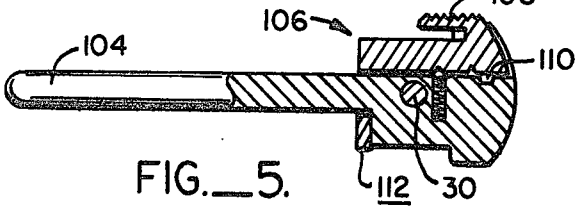
FIG. 5 is an enlarged, partial cross-sectional view of the enclosure end member and safety taken along lines 5—5 of FIG. 2.

Hammer spring 94 is guided by a spindle portion 104 of an enclosure end member 106 shown in FIGS. 2 and 5. Member 106 is mounted at the rearward end of enclosure 10 via screw 30. The enclosure end member includes a safety 108 adapted to move between two detent positions. The forward or safety off position is shown in FIG. 2 while the rear or safety on position is shown in FIG. 5. Typically a red dot 110 is provided to show when the safety is on or off by visual observation. When the safety is in the rear or safe position of FIG. 5, surface 112 keeps the rear projection 113 of pivot arm 98 from pivoting upwardly thus ensuring that trigger surface 96 does not disengage hammer surfaces 102 or 103.

When in the firearm mode of FIG. 2, the action of the hammer striking leg 74 of the firing pin causes the forward end of leg 70 of the firing pin to impact against the rim of the cartridge. This causes the rim fire cartridge chambered within cartridge chamber device 36 to be activated thus firing the weapon. The forward motion of the hammer is halted by leg 74 of the firing pin.

When the weapon is fired in the airgun mode, shown in FIG. 3, the center hammer surface 114 strikes the rear end of gas pin 116 thus causing pin 116 to move forward to allow compressed gas within pressurized gas chamber 118 to pass along a path indicated by arrow 120 from chamber 118 to port 84 and into the pellet chamber of pellet chamber device 80 thus propelling the pellet 122 through the barrel and out the muzzle. The hammer is halted by the force of spring 124 and the force of the compressed gas within the pressurized gas portion 126 of enclosure 10. The greater the striking force of hammer 78 against pin 116, the greater the volume of pressurized gas which is available to power the pellet. Therefore, the user can choose the power desired by the choice engagement of surface 96 with either hammer surfaces 102 or 103. Of course, the supply of pressurized gas is exhausted sooner when the maximum power hammer surface (102) is used compared with the regular or minimum power hammer surface (103). Gas pin spring 124 thereafter forces gas pin 116 and associated packing material rearwardly to reseal the pressurized gas chamber. Stop 90 acts in a similar manner as leg 74 to push the hammer rearwardly when the bolt is forced to the rear thus recocking the weapon and opening the chamber to accept a new projectile.

OTHER FEATURES

In the preferred embodiment pressurized gas is introduced into gas portion 126 from a pressurized gas source, not shown, such as a compressed $CO_2$ tank. The source is fluidly coupled to threaded port 127. Gas from the source enters entry bore 129 and forces plug 131 rearward against sealing spring 133 to allow gas to pass from the source, through port 127, through bore 129, past plug 131 and into gas portion 126 through a central bore 135 in positioning plug 137. If desired, forward end of enclosure 10 could be modified to allow a smaller, portable compressed gas cartridge to be mounted within gas portion 126.

Figure 6:
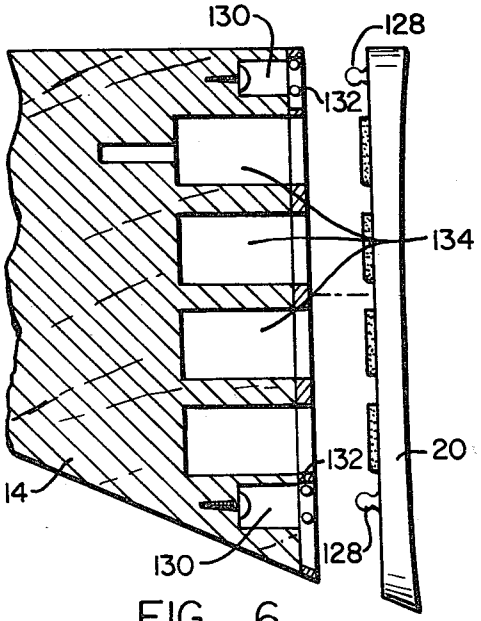
FIG. 6 is a cross-sectional view of the butt end of the stock.

Turning now to FIG. 6, butt plate 20 has a pair of projections 128 for insertion into cavities 130. The butt plate is secured to the end of the stock in a conventional manner such as by snap rings 132. The stock has four storage compartments 134 sized to accommodate the various bolt faces and chamber devices to be used. Therefore, the weapon can accommodate three sets of bolt faces and chamber devices, one set mounted within the bolt housing and the other two sets in the storage compartments of the shoulder stock. As shown in FIG. 1, bolt face 40' and chamber device 36', typically for firing magnum shells, are stored in the storage compartments while bolt face 40 and chamber device 36, typically for firing standard shells, are to be mounted in the bolt housing.

OPERATION IN FIREARM MODE

Although the operation of the disclosed invention should be apparent, it will now be discussed briefly for the firearm mode first and then the airgun mode. Turning our attention primarily to FIG. 2, and assuming the bolt is disposed rearwardly and that the safety is in a safe position, the user first inserts the cartridge within the cartridge chamber device. Grasping handle 48 the bolt assembly is urged forward until the larger outer diameter of the handle is seated within the countersunk portion of slot 52 thus locking the bolt in place. As the bolt moves forward, extractor 62 engages the outer rim of the cartridge. When the user desires to fire the weapon, safety 108 is pushed forward and trigger 99 is pulled. The hammer is thrown forward by the force of hammer spring 94 and impacts against leg 74 of the firing pin thus forcing the forward edge of leg 70 against the rim of the cartridge. The primer within the cartridge ignites the propellant which energetically forces the bullet through the bore of the barrel and out the muzzle.

The user than grasps handle 48 and pulls it outwardly to disengage the handle from the countersunk portion of the slot so that the bolt assembly may be drawn rearwardly. As the bolt assembly is forced to the rear, leg 74 of the firing pin forces the hammer against the hammer spring until trigger surface 96 reengages hammer surface 102. Also, the spent cartridge casing is withdrawn from the cartridge chamber device by the extractor and flipped away from the weapon through port 28 by the interaction of extractor 62 and the forward force on the rim exerted by firing pin 68. If desired the user can push safety 108 rearwardly to a safe position. This sequence can then be repeated.

OPERATION IN AIRGUN MODE

The sequence of events when the weapon is used as an airgun is similar to that when used as a firearm. However, the pellet is inserted into its proper position within the pellet chamber device by placing the pellet over the end of loading ram 92 and then forcing the bolt assembly forward to its locked position. When the trigger is pulled, the hammer is thrown forward so that surface 114 impacts against the rearward end of gas pin 116 thus allowing the flow of gas along a path defined by arrow 120 to occur. Forward movement of the hammer is halted by the combined force of spring 124 and the pressurized gas. Gas spring 124 then forces gas pin 116 and hammer 78 rearwardly to again seal the pressurized gas chamber. The pressurized gas entering the pellet chamber defined within pellet chamber device 80 thus forces pellet 122 through the bore of the barrel and out of the muzzle. To reload, the hammer is forced rearwardly against the hammer spring by puller 90 as the bolt assembly is drawn to the rear. This sequence can then be repeated.

ALTERNATIVE EMBODIMENTS

Figure 7:
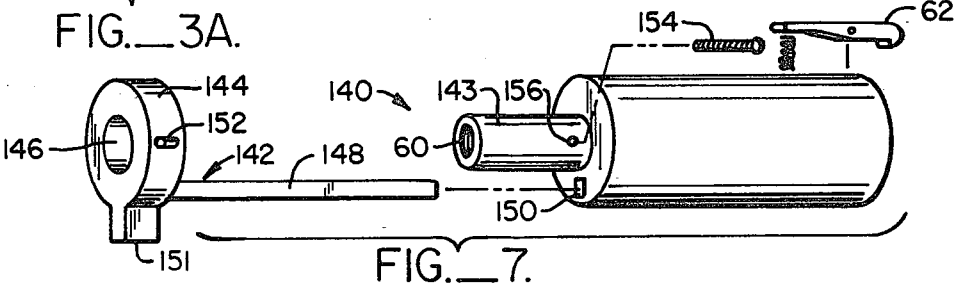
FIG. 7 is an isometric view of an alternative embodiment of the cartridge bolt face.

An alternative of cartridge bolt face is shown in FIG. 7. Bolt face 140 is configured in a like manner as bolt face 40 with the following distinctions. Bolt face 140 includes a firing pin 142 mounted at the rearward end 143 of bolt face 140 over threaded hole 60. Firing pin 142 has a circular ring 144 having an aperture 146 sized to fit over end 143. Narrow leg 148 extends axially from ring 144 and is sized to fit within a hole 150 within bolt face 140. A leg 151 extending radially from ring 144 corresponds to leg 74. Hole 150 corresponds to passageway 72. Ring 144 has an axially extending slot 152. After placement of leg 148 within hole 150 and end 143 within aperture 146, a screw 154 is inserted through slot 152 to engage a complementary threaded hole 156 in end 143. The fit of screw 154 within slot 152 is loose to allow the firing pin to move axially when the hammer strikes leg 151. However, the firing pin 142 cannot be inadvertently lost, such as when changing from one firing mode to another, because screw 154 insures it stays engaged with end 143.

In the disclosed embodiment, handle 48 is shown extending from the lefthand side of the bolt housing and the ejector is shown situated at the top of the cartridge bolt face. The user may desire to extend handle 48 from the righthand side of the bolt housing which would be the conventional manner for righthanded shooters. The ejector may be situated along the right side of the cartridge bolt face so that the ejected shells are thrown to the side rather than upwardly. Also, a chamber device and bolt face could be configured to fire center-fire cartridges if desired. Although the invention has been described with reference to a shoulder fired weapon, it may also be practiced via a handgun. Other modification and revision may also be made without departing from what is regarded to be the subject of the invention.

I claim:

1. A convertible firearm-airgun comprising:

a barrel having a muzzle end and a chamber end and defining a bore therethrough between said muzzle end and said chamber end;

a bolt housing having a bolt cavity therein;

means for mounting said bolt housing to the chamber end of said barrel with said bolt cavity aligned with said bore;

a first chamber device defining a first chamber, said first chamber configured for chambering a cartridge therein, said first chamber device including a firing pin;

a second chamber device defining a second chamber, said second chamber configured for chambering a compressed-gas projectile therein;

means for selectively mounting either said first or said second chamber devices adjacent the bore at the chamber end of the barrel;

a first bolt assembly configured to be housed within said bolt cavity and adapted to movably engage the head of a cartridge chambered within said first chamber;

a second bolt assembly configured to be housed within said bolt cavity and adapted to movably engage an end of said second chamber;

a compressed gas chamber;

means for selectively fluidly connecting said compressed gas chamber and said second chamber when said second chamber device is mounted adjacent said bore; and means for actuating either said firing pin when said first bolt assembly is mounted within said bolt cavity or said selective fluid connecting means when said second bolt assembly is mounted within said bolt cavity.

2. The firearm-airgun of claim 1 wherein said actuating means includes a hammer and trigger assembly, said assembly including a hammer and a trigger means for selectively releasing said hammer, said hammer biased for engagement with a portion of said firing pin after release by said trigger means when said first bolt assembly is mounted within said bolt cavity, and said hammer biased for engagement with said selective fluid connecting means when said second bolt assembly is mounted within said bolt cavity, thereby respectively either causing said firing pin to engage the head of a cartridge chambered within said first chamber, or causing compressed gas to enter said second chamber to force a compressed gas projectile from said barrel.

3. The firearm-airgun of claim 1 wherein said firearm-airgun is a shoulder-fired weapon.

4. The firearm-airgun of claim 1 wherein said bolt cavity is collinear with said bore.

5. The firearm-airgun of claim 1 wherein said first chamber device has a forward facing barrel end and a rearward facing bolt end, said bolt end having means for extracting said first chamber device from said chamber device selective mounting means at the barrel end thereof.

6. The firearm-airgun of claim 2 including means for cocking said hammer.

7. The firearm-airgun of claim 1 wherein said selective fluid connecting means includes a port defined by said second chamber device extending transverse the second chamber.

8. The firearm-airgun of claim 2 wherein said hammer includes a plurality of surfaces for engagement by said trigger means.

9. The firearm-airgun of claim 1 wherein said chamber device selective mounting means includes means for locking either said first or second chamber devices within a chamber cavity formed within said bolt housing.

10. The firearm-airgun of claim 1 wherein said first and second bolt assemblies include a bolt and first and second bolt faces which are mounted to said bolt to comprise said first and second bolt assemblies respectively.

11. The firearm-airgun of claim 7 wherein said compressed-gas projectile is a pellet.

12. The firearm-airgun of claim 11 wherein said second bolt assembly includes means for inserting said pellet within said second chamber past said port in said second chamber device.

13. The firearm-airgun of claim 1 wherein said firing pin is a rim-fire firing pin.

14. The firearm-airgun of claim 2 wherein said trigger assembly includes:

a pivotal trigger;

a trigger pivot arm mounted adjacent said trigger for pivotal actuation thereby, said pivot arm including a hammer-engaging portion biased to engage said hammer.

15. The firearm-airgun of claim 14 including safety means for preventing said trigger pivot arm from pivoting thereby preventing the release of said hammer engaged thereby.

16. The firearm-airgun of claim 1 further comprising stock means for holding said weapon, said stock means including means for storing at least one said chamber device and at least one said bolt assembly.

17. An improved convertible firearm-airgun weapon of the type having a barrel having a muzzle end and a chamber end and a bore therethrough, means for holding said weapon, trigger means for activating a firing pin when in a firearm mode, means for activating a pressurized gas source when in an airgun mode, the improvement comprising:

at least one removable chamber means configured to be mounted adjacent said bore at the chamber end of said barrel one at a time;

at least one removable bolt means configured to be mounted adjacent a corresponding chamber means; and said at least one said chamber means and corresponding bolt means adapted for using said weapon either as a firearm or as an airgun.

18. The improved firearm-airgun of claim 17 wherein said chamber means adapted for using said weapon as an airgun includes a chamber device having a lateral hole defining a portion of the fluid path between said pressurized gas source and the chamber volume defined by said chamber device.

19. A convertible firearm-airgun weapon of the type including a barrel having a muzzle end and a chamber end and a bore, a handgrip for holding the weapon, a pressurized gas chamber for propelling an airgun projectile, and a trigger assembly for firing the weapon, the improvement comprising:

at least one chamber means adapted to be mounted adjacent said bore at the chamber end of said barrel;

at least one bolt means adapted to be mounted adjacent a corresponding chamber means;

said at least one said chamber means and corresponding bolt means adapted for using said weapon either as a firearm or as an airgun;

hammer means coupled to said trigger assembly either for actuating pressurized gas venting means fluidly connecting said gas chamber and said chamber means to propel a pressurized gas projectile through said barrel when said chamber means is adapted for use of said weapon as an airgun or for striking a portion of said bolt means to fire a cartridge chambered in said chamber when said bolt means and chamber means is adapted for use of said weapon as a firearm.

20. The improved firearm-airgun of claim 19 wherein said hammer means includes a spring-biased, dual powered hammer.

21. A convertible firearm-airgun comprising:

a barrel defining an internal bore, said barrel having a muzzle end and a chamber end;

a bolt housing mounted to said chamber end of said barrel;

first and second removable projectile chamber devices each adapted to be singularly mounted within said bolt housing adjacent said chamber end of said barrel, said chamber devices having first and second chambers formed to lie coaxial with said bore when said chamber devices are so mounted;

a bolt assembly mounted within said bolt housing and adapted to move within said bolt housing along a path generally parallel to the axis of said bore;

said bolt assembly including a bolt and first and second removable bolt faces, each of said bolt faces adapted to be removably mounted to the forward end of said bolt to lie opposite said first and second removable chamber devices respectively;

said first chamber device and said first bolt face adapted for use with a cartridge;

said second chamber device and said second bolt face adapted for use with a compressed-gas projectile;

an elongate enclosure mounted to and along said barrel and said bolt housing, said enclosure having a pressurized gas portion at one end, means for controllably releasing pressurized gas from said pressurized gas portion to an exit port, and having a hammer portion at the other end;

means for fluidly connecting said exit port and said second chamber of said second chamber device;

said first bolt face including a firing pin, a portion of said firing pin extending transverse the axis of said bore to a point within said hammer portion of said elongate enclosure; and said hammer portion including a hammer, trigger means for releasably engaging said hammer, and means for biasing said hammer toward said lower portion of said firing pin when said first bolt face is mounted to said bolt, and toward said controllable gas release means for release of pressurized gas through said exit port, through said fluid connecting means and into said second chamber when said second bolt face and said second chamber device are mounted to said bolt and said chamber housing.

22. An improved weapon of the type having a barrel having a muzzle end and a chamber end and a bore therethrough, means for holding said weapon, trigger means for activating a firing pin when in a firearm mode, means for activating a pressurized gas source when in an airgun mode, the improvement comprising:

at least one removable chamber means configured to be mounted adjacent said bore at the chamber end of said barrel one at a time;

at least one removable bolt means configured to be mounted adjacent a corresponding chamber means; and said at least one chamber means and corresponding bolt means adapted for using said weapon as a firearm.

23. An improved weapon of the type for use with replaceable chamber devices and corresponding bolt face devices, the weapon having a barrel with a muzzle end and a chamber end and a bore therethrough, trigger means for activating a firing pin when in a firearm mode, means for activating a pressurized gas source when in an airgun mode, the improvement comprising:

means for mounting one said chamber device adjacent said bore at the chamber end of said barrel; and means for mounting one said corresponding bolt face device adjacent said chamber device mounting means.

* * * * *